US012173422B2

(12) United States Patent
Pape et al.

(10) Patent No.: US 12,173,422 B2
(45) Date of Patent: Dec. 24, 2024

(54) ELECTROPLATING COMPOSITION AND METHOD FOR ELECTROPLATING A CHROMIUM COATING ON A SUBSTRATE

(71) Applicant: Atotech Deutschland Gmbh & Co. KG, Berlin (DE)

(72) Inventors: Simon Pape, Berlin (DE); Oleksandra Yevtushenko, Berlin (DE); Anke Walter, Berlin (DE); Thorsten Ross, Berlin (DE)

(73) Assignee: Atotech Deutschland GmbH & Co. KG, Berlin (DE)

( * ) Notice: Subject to any disclaimer, the term of this patent is extended or adjusted under 35 U.S.C. 154(b) by 0 days.

(21) Appl. No.: 18/258,048

(22) PCT Filed: Dec. 17, 2021

(86) PCT No.: PCT/EP2021/086438
§ 371 (c)(1),
(2) Date: Jun. 16, 2023

(87) PCT Pub. No.: WO2022/129491
PCT Pub. Date: Jun. 23, 2022

(65) Prior Publication Data

US 2024/0035183 A1 Feb. 1, 2024

(30) Foreign Application Priority Data

Dec. 18, 2020 (EP) ..... 20215662

(51) Int. Cl.
*C25D 3/08* (2006.01)
*C25D 3/10* (2006.01)
*C25D 5/00* (2006.01)

(52) U.S. Cl.
CPC ..... *C25D 3/10* (2013.01)

(58) Field of Classification Search
CPC ..... C25D 3/10; C25D 5/00; C25D 3/08
USPC ..... 205/290
See application file for complete search history.

(56) References Cited

U.S. PATENT DOCUMENTS

| | | | | |
|---|---|---|---|---|
| 3,432,408 | A * | 3/1969 | Valayil | C25D 3/10 205/290 |
| 4,897,166 | A | 1/1990 | Melzer et al. | |
| 5,104,496 | A * | 4/1992 | Dupree | C25D 21/11 204/229.4 |
| 11,124,530 | B1 * | 9/2021 | Helal | G01N 21/6428 |

FOREIGN PATENT DOCUMENTS

| | | | | |
|---|---|---|---|---|
| CN | 111171323 | A * | 5/2020 | C08G 77/38 |
| KR | 100293210 | B1 * | 7/2001 | C25D 11/38 |
| WO | WO-9800585 | A1 * | 1/1998 | C25D 21/11 |
| WO | WO-2019224286 | A1 * | 11/2019 | C23C 18/122 |

OTHER PUBLICATIONS

Thompson et al., "Rapid Assembly of Complex 3D Siloxane Architectures," Journal of the American Chemical Society (Jan. 9, 2008), vol. 130, No. 1, pp. 32-33. (Year: 2008).*
PCT/EP2021/086438; International Search Report and Written Opinion of the International Searching Authority dated Mar. 25, 2022.

* cited by examiner

*Primary Examiner* — Edna Wong
(74) *Attorney, Agent, or Firm* — Renner, Otto, Boisselle & Sklar, LLP

(57) ABSTRACT

The present invention refers to an electroplating composition for plating a chromium coating on a substrate, the composition comprising:
(i) a source of hexavalent chromium;
(ii) one or more than one betaine comprising a quaternary nitrogen and/or salts thereof; and
(iii) one or more than one poly-organosiloxane.

14 Claims, No Drawings

ELECTROPLATING COMPOSITION AND METHOD FOR ELECTROPLATING A CHROMIUM COATING ON A SUBSTRATE

This application is a national phase of International Application No. PCT/EP2021/086438, filed 17 Dec. 2021, which claims priority to European Patent Application No. 20215662.6, filed 18 Dec. 2020, each of which is hereby incorporated herein by reference in its entirety.

FIELD OF THE INVENTION

The present invention relates to an electroplating composition and a respective method for electroplating a chromium coating on a substrate as well as a particular use of a poly-organosiloxane for reducing the surface tension. The invention is based on a synergistic effect.

BACKGROUND OF THE INVENTION

Chromium plating has a far-reaching history for decorative and functional applications. Although starting with hexavalent chromium plating, development of trivalent chromium plating has been started during the last decades in order to replace environmentally problematic hexavalent chromium species. However, hexavalent chromium plating which cannot be replaced so far by trivalent chromium plating is still subject of further developments and improvements.

It is well known that hexavalent chromium plating typically leads to the formation of undesired mist and foam due to the utilization of surfactants (also known as surface-active compounds) and an intensive gas formation during plating. Surfactants are typically used in order to decrease the surface tension but also to intentionally form a foam blanket for mist suppression. As a result, a hexavalent chromium plating composition often exhibits a very low surface tension of about 32 mN/m. This usually allows an excellent plating result even with substrates having a sophisticated geometry.

However, plating and composition parameters for hexavalent chromium are harsh due to the use of strongly oxidizing chromic acid. Typically, organic compounds quickly decompose and undesired break-down products are formed, which dramatically reduce the long-term performance of a respective electroplating composition. Upon accumulation of these break-down products, typically current efficiency is significantly dropping.

In order to overcome this disadvantage, chemical highly stable organic compounds have been developed, such as fluorinated surfactants, either fully or partially fluorinated. It has been shown that such organic compounds excellently withstand the harsh conditions. Furthermore, fluorinated surfactants have been proven to be very efficient in decreasing the surface tension.

A typical drawback of surfactants in general is the formation of too much foam. Therefore, in many cases anti-foam compounds are used in combination with surfactants in order to limit or in some cases to eliminate the formation of foam. However, since anti-foam compounds are typically also of organic nature, they suffer the same problems as surfactants. Under harsh plating and composition parameters they are also subject of rapid decomposition and therefore a large contributor to undesired break-down products.

In order to make anti-foam compounds chemically more resistant, fluorination was also applied to this group of compounds. Such fluorinated anti-foam compounds are for example disclosed in DE 37 23 198 A1. DE'198 A1 refers to per-fluorinated anti-foam compounds for electroplating compositions comprising surfactants (preferably fluorinated surfactants). It is disclosed that said anti-foaming compounds remove foam without impairing the surface tension achieved by said surfactants.

However, the excellent chemical resistance of such fluorinated organic compounds creates massive environmental problems because they are not biologically degradable. If not properly disposed they are an environmental threat. Thus, wastewater treatment as well as disposal of electroplating compositions is very demanding and challenging.

In the past, attempts have been made to develop for example surfactants for hexavalent chromium plating which are free of fluorine and therefore environmentally more acceptable. For example, U.S. Pat. No. 3,432,408 A refers to a chromium plating electrolyte and a method for preventing mist therein. For that purpose, the electrolyte comprises surface-active sulfobetaines, in particular useful for hexavalent chromium plating electrolytes.

CN 111171323 A refers to an organic silicon compound as an environmentally friendly fluorine-free mist inhibitor.

Although such surface-active sulfobetaines are environmentally more acceptable, the problem remains that such compounds are often not sufficiently stable in hexavalent chromium plating compositions and often do not lead to the desired surface tension as obtained with fluorinated surfactants.

There is thus an ongoing demand to further improve hexavalent chromium compositions.

OBJECTIVE OF THE PRESENT INVENTION

It was therefore the objective of the present invention to provide an electroplating composition comprising fluorine-free surfactants but without impairing the current efficiency and surface tension, in particular compared to commonly used fluorinated surfactants.

Furthermore, it was an objective to prevent degradation products from impairing the long-term performance of a respective electroplating composition.

SUMMARY OF THE INVENTION

The objectives mentioned above are solved by an electroplating composition for plating a chromium coating on a substrate, the composition comprising:

(i) a source of hexavalent chromium;

(ii) one or more than one betaine comprising a quaternary nitrogen and/or salts thereof; and (iii) one or more than one poly-organosiloxane.

Furthermore, the objectives above are solved by a respective method of the present invention for electroplating a chromium coating on a substrate.

Own experiments have shown (see Examples below) that with the specific combination of compounds (ii) and (iii), each preferably as defined throughout the present text, most preferably defined as being preferred, an excellent surface tension as achieved with fluorinated surfactants was obtained. Most surprisingly, the obtained surface tension is a result of a synergistic effect between (ii) and (iii), which was not expected. Although a significantly stronger decomposition of (ii) and (iii) in the electroplating composition is inevitable, own experiments have shown that no undesired decomposition products are formed over time impairing the long-term performance of the electroplating composition. It is assumed that a complete degradation takes places, which fully inactivates the decomposition products over time. Although a preferably continuous or at least semi-continuous dosing is needed, the entire method of the present invention can be performed without any single fluorinated organic compound over the entire lifetime. Advantageously, no reduced long-term performance is observed over time compared to the utilization of fluorinated surfactants.

It is furthermore of great benefit that the combination of (ii) and (iii) can be applied to a broad variety of electroplating compositions comprising a source of hexavalent chromium, namely electroplating compositions for functional (also referred to as hard chrome) as well as decorative applications.

Typically, functional applications strive for very hard, and wear resistant chromium coatings, preferably having a comparatively thick layer thickness (typically up to several hundreds of micrometers). In contrast, decorative applications have a very high demand regarding optical uniformity and commonly are comparatively thin (typically between 50 nm and 2000 nm). Own experiments have shown that the combination of (ii) and (iii) can be applied to both applications.

Thus, in some cases the electroplating composition of the present invention is preferably for plating a functional chromium coating. Respectively, the chromium coating is preferably a functional chromium coating, preferably a hard, wear-resistant functional chromium coating.

In other cases, the electroplating composition is preferably for plating a decorative chromium coating. Respectively, the chromium coating is preferably a decorative chromium coating.

If not explicitly stated otherwise, the features regarding the present invention preferably apply to functional as well as to decorative applications.

DETAILED DESCRIPTION OF THE INVENTION

In the context of the present invention, the terms "at least one", "one or more", or "one or more than one" denote (and are exchangeable with) "one, two, three or more" and "one, two, three or more than three", respectively, if appropriate.

The term "substantially free of" denotes insignificant amounts thereof, not affecting the various aspects of the present invention. The term "does not comprise" typically denotes that the total amount of such compounds and ingredients is below the detection range and most preferably is not present at all.

(i) The Source of Hexavalent Chromium

The electroplating composition of the present invention comprises (i) a source of hexavalent chromium. The term, "hexavalent chromium" refers to the element chromium with the oxidation number +6. A source thereof denotes each compound (incl. ions) comprising this element.

Preferred is an electroplating composition of the present invention, wherein the source of hexavalent chromium comprises chromic acid and/or chromium trioxide, more preferably chromium trioxide solubilized as chromic acid. Most preferably chromic acid and chromium trioxide, respectively, are the only source of hexavalent chromium.

Preferred is an electroplating composition of the present invention, wherein the source of hexavalent chromium has a concentration ranging from 75 g/L to 480 g/L, based on the total volume of the electroplating composition, preferably from 105 g/L to 460 g/L, more preferably from 150 g/L to 440 g/L, even more preferably from 200 g/L to 420 g/L, most preferably from 225 g/L to 400 g/L. The concentration of the source of hexavalent chromium in the context of the present invention is preferably referenced to $CrO_3$. In many cases aforementioned concentrations preferably apply to both functional and decorative applications, preferably to functional applications.

In some cases an electroplating composition of the present invention is preferred, wherein the source of hexavalent chromium has a concentration ranging from 210 g/L to 290 g/L, preferably from 220 g/L to 280 g/L, more preferably from 230 g/L to 270 g/L, most preferably from 235 g/L to 265 g/L. This also preferably applies to both functional and decorative applications.

However, in some other cases an electroplating composition of the present invention is preferred, wherein the source of hexavalent chromium has a concentration ranging from 281 g/L to 420 g/L, preferably from 291 g/L to 400 g/L, more preferably from 300 g/L to 390 g/L, even more preferably from 320 g/L to 380 g/L, most preferably from 340 g/L to 370 g/L. This most preferably applies to some decorative applications.

Preferably, the source of hexavalent chromium is dissolved in water by forming an aqueous solution. Thus, the electroplating composition of the present invention is preferably an aqueous electroplating composition, most preferably comprising more than vol.-% water, based on the total volume of the electroplating composition.

Preferred is an electroplating composition of the present invention, wherein the pH is strongly acidic. This means, the pH is preferably 1 or below, most preferably zero or below.

(ii) One or More Than One Betaine Comprising A Quaternary Nitrogen and/or Salts Thereof The electroplating composition of the present invention comprises (ii) one or more than one betaine comprising a quaternary nitrogen and/or salts thereof. The quaternary nitrogen is preferably charged with a positive charge. Most preferably, the positive charge cannot be removed by deprotonation. This means that the positive charge is stabilized.

Preferred is an electroplating composition of the present invention, wherein the quaternary nitrogen has substituents such that said positive charge results, with the proviso that the substituents are not hydrogen. Preferably, said substituents comprise at least organic residues, preferably alkyl residues, ester residues, carboxy alkyl residues, and/or amide residues. Preferably, the alkyl residues, ester residues, carboxy alkyl residues, and amide residues each individually comprise 1 to 20 carbon atoms.

Preferably, the one or more than one betaine independently comprises further a sulfonate group and/or carboxylate group, preferably a sulfonate group. They are preferably charged with a negative charge.

Preferred is an electroplating composition of the present invention, wherein the one or more than one betaine has a neutral net charge.

Preferred is an electroplating composition of the present invention, wherein said one or more than one betaine independently comprises at least 5 carbon atoms, preferably at least 7 carbon atoms, more preferably at least 9 carbon atoms, even more preferably at least 11 carbon atoms, yet even more preferably at least 12 carbon atoms, most preferably at least 14 carbon atoms. Preferably, said one or more than one betaine has not more than 50 carbon atoms.

Preferred is an electroplating composition of the present invention, wherein said one or more than one betaine is amphiphilic. Thus, said one or more than one betaine preferably comprises at least one (preferably one) hydrophobic moiety. Furthermore, more preferably said one or more than one betaine comprises both at least one (preferably one) hydrophilic moiety and at least one (preferably one) hydrophobic moiety.

Most preferably said one or more than one betaine is (not only amphiphilic but even) surface-active.

More preferably, said one or more than one betaine is surface-active and is leading to a surface tension of 40 mN/m or less, referenced to DI water having a surface tension of 70 mN/m or more, preferably of 39 mN/m or less, more preferably of 37 mN/m or less. Most preferably this is referenced to a concentration of 30 mg/L of said one or more than one betaine. Preferably, said one or more than one betaine is leading to a surface tension of not less than 36 mN/m.

More preferred is an electroplating composition of the present invention, wherein said one or more than one betaine is a surfactant.

Preferred is an electroplating composition of the present invention, wherein said one or more than one betaine comprises a compound of formula (I)

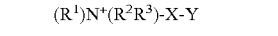

$$(R^1)N^+(R^2R^3)\text{-}X\text{-}Y \quad (I),$$

wherein independently $R^1$ denotes alkyl, alkyl ester, or alkyl amid, preferably alkyl;

$R^2$ and $R^3$ denote a C1-C5 linear or branched alkyl, preferably a C1-C5 linear alkyl;

X denotes a divalent moiety; and

Y denotes a sulfonic acid group or a carboxylic acid group, preferably a sulfonic acid group.

Preferred is an electroplating composition of the present invention, wherein $R^1$ is branched or linear, preferably linear.

Preferred is an electroplating composition of the present invention, wherein $R^1$ comprises 4 to 26 carbon atoms, preferably 6 to 24, more preferably 8 to 20, most preferably 12 to 18. Most preferably, $R^1$ comprises 18 carbon atoms.

Preferred is an electroplating composition of the present invention, wherein $R^2$ and $R^3$ independently comprise 1 to 4 carbon atoms, preferably 1 to 3 carbon atoms, more preferably 1 or 2 carbon atoms, most preferably 1 carbon atom.

Preferred is an electroplating composition of the present invention, wherein X comprises 1 to 8 carbon atoms, preferably 1 to 6 carbon atoms, more preferably 2 to 4 carbon atoms, most preferably 3 or 4 carbon atoms.

Preferred is an electroplating composition of the present invention, wherein X denotes an alkylene moiety, hydroxyalkylene moiety, or alkoxylene moiety, preferably an alkylene moiety. Most preferably, X denotes propylene, preferably linear propylene.

Preferred is an electroplating composition of the present invention, wherein independently $R^1$ denotes a C16-C18 linear alkyl, preferably a C18 linear alkyl;

$R^2$ and $R^3$ denote methyl or ethyl, preferably methyl;

X denotes a C2-C4 alkylene moiety, preferably a C3 alkylene moiety; and

Y denotes a sulfonic acid group.

Preferred is an electroplating composition of the present invention, wherein said one or more than one betaine is a sulfobetaine.

Preferred is an electroplating composition of the present invention, wherein said one or more than one betaine at least comprises one or more (preferably one) out of N,N-Dimethyl-N-(3-cocoamidopropyl)-N-(2-hydroxy-3-sulfopropyl) ammonium betaine, N-Dodecyl-N,N-dimethyl-3-ammonio-1-propanesulfonate, N-Octyl-N,N-dimethyl-3-ammonio-1-propanesulfonate, N-Decyl-N,N-dimethyl-3-ammonio-1-propanesulfonate, N-Dodecyl-N,N-dimethyl-3-ammonio-1-propanesulfonate, N-Tetradecyl-N,N-dimethyl-3-ammonio-1-propanesulfonate, N-Hexadecyl-N,N-dimethyl-3-ammonio-1-propanesulfonate, N-Octadecyl-N,N-dimethyl-3-ammonio-1-propanesulfonate, and N,N-Dime-thyl-N-dodecylglycine betaine.

Preferred is an electroplating composition of the present invention, wherein said one or more than one betaine does not comprise a phospholipid, preferably said one or more than one betaine does not comprise a phosphorous atom.

Preferred is an electroplating composition of the present invention, wherein said one or more than one betaine has a total concentration ranging from 0.0005 g/L to 1 g/L, based on the total volume of the electroplating composition, preferably from 0.001 g/L to 0.5 g/L, more preferably from 0.005 g/L to 0.3 g/L, and most preferably from 0.01 g/L to 0.2 g/L.

Preferred is an electroplating composition of the present invention, wherein in the electroplating composition said one or more than one betaine does not comprise fluorine atoms. In other words, said one or more than one betaine is not fluorinated and fluorine-free, respectively.

(iii) One or More than One Poly-Organosiloxane

The electroplating composition of the present invention comprises (iii) one or more than one poly-organosiloxane. In the context of the present invention (ii) and (iii) are distinct compounds.

Preferably, the one or more than one poly-organosiloxane is structurally modified, most preferably in its over-all structure.

Thus, preferred is an electroplating composition of the present invention, wherein the poly-organosiloxane is crosslinked, preferably is at least 2-dimenionally crosslinked, most preferably is 3-dimensionally crosslinked.

Preferred is an electroplating composition of the present invention, wherein the one or more than one poly-organosiloxane is crosslinked via vinyl moieties.

Preferred is an electroplating composition of the present invention, wherein the one or more than one poly-organosiloxane is a 3D-siloxane, i.e. a 3D poly-organosiloxane. They are for example available from Münzing Chemie GmbH.

Preferred is an electroplating composition of the present invention, wherein the one or more than one poly-organosiloxane is chemically modified. It is most preferred that it is chemically modified in such a way that the one or more than one poly-organosiloxane is amphiphilic. Thus, preferred is an electroplating composition of the present invention, wherein the one or more than one poly-organosiloxane is amphiphilic.

Thus, the one or more than one poly-organosiloxane preferably comprises at least one (preferably repeating) hydrophilic moiety. Furthermore, more preferably the one or more than one poly-organosiloxane comprises both at least one (preferably repeating) hydrophilic moiety and at least one (preferably repeating) hydrophobic moiety.

More preferred is an electroplating composition of the present invention, wherein the one or more than one poly-organosiloxane is surface-active.

More preferably, the one or more than one poly-organosiloxane on its own is less surface-active compared to said one or more than one betaine in terms of reducing the surface tension, referenced to water without any surface-active compound.

Most preferably, the one or more than one poly-organosiloxane and said one or more than one betaine are together synergistically more surface-active in terms of reducing the surface tension, referenced to water without any surface-active compound, than each one on its own. This is the unexpected effect utilized in the present invention.

Thus, the one or more than one poly-organosiloxane preferably comprises a surfactant, most preferably is a surfactant. This means that most preferably the one or more than one poly-organosiloxane is a surfactant by itself. More preferably, the one or more than one poly-organosiloxane is surface-active and is leading to a surface tension of mN/m or less, referenced to DI water having a surface tension of 70 mN/m or more, preferably of 57 mN/m or less, more preferably of 54 mN/m or less. Most preferably this is referenced to a concentration of 30 mg/L of the one or more than one poly-organosiloxane. Preferably, the one or more than one poly-organosiloxane is leading to a surface tension of not less than 51 mN/m.

Preferred is an electroplating composition of the present invention further comprising at least one emulsifier. It preferably emulsifies the one or more than one poly-organosiloxane in the electroplating composition. Thus, the emulsifier is preferably for emulsifying the one or more than one poly-organosiloxane in an aqueous solution.

Therefore, preferred is an electroplating composition of the present invention, wherein said one or more than one poly-organosiloxane is emulsified in the electroplating composition. It preferably is an emulsified poly-organosiloxane. Thus, preferred is an electroplating composition of the present invention, wherein the electroplating composition comprises an emulsion.

The electroplating composition preferably comprises said one or more than one poly-organosiloxane in a well and finely distributed manner, most preferably due to the emulsifier.

Preferred is an electroplating composition of the present invention, wherein in the electroplating composition said one or more than one poly-organosiloxane is homogeneously distributed.

This preferably means that the electroplating composition does not show any phase separation, floating surface droplets, oil surface-film formation, and/or density gradients.

Typically, a homogeneous distribution is preferably characterized by a homogeneous light transmission through an aqueous solution, preferably the electroplating composition, if a respective transmission test is carried out. Typically, a skilled person knows how to perform such a comparatively simple test.

Preferred is an electroplating composition of the present invention, wherein the electroplating composition is substantially free of, preferably does not comprise, polydimethylsiloxane, most preferably is substantially free of, preferably does not comprise, a silicone oil. Thus, the one or more than one poly-organosiloxane preferably does not comprise this but rather is excluding this. Own experiments have shown that silicone oils and in particular polydimethylsiloxane is not sufficiently amphiphilic (and therefore insufficiently surface-active) and/or is forming an undesired inhomogeneous distribution including a phase separation; in some cases despite utilizing an emulsifier.

Preferred is an electroplating composition of the present invention, wherein the one or more than one poly-organosiloxane is non-ionic.

Preferred is an electroplating composition of the present invention, wherein the one or more than one poly-organosiloxane has a total concentration ranging from 0.01 mg/L to 5000 mg/L, based on the total volume of the electroplating composition, preferably from 0.05 mg/L to 3000 mg/L, more preferably from 0.1 mg/L to 1500 mg/L, even more preferably from 0.15 mg/L to 1000 mg/L, yet even more preferably from 0.2 mg/L to 500 mg/L, most preferably from 0.25 mg/L to 150 mg/L.

More preferred is an electroplating composition of the present invention, wherein the one or more than one poly-organosiloxane has a total concentration ranging from 0.01 mg/L to 100 mg/L, based on the total volume of the electroplating composition, preferably from 0.05 mg/L to 70 mg/L, more preferably from 0.1 mg/L to 50 mg/L, even more preferably from 0.15 mg/L to 25 mg/L, yet even more preferably from 0.2 mg/L to 10 mg/L, most preferably from 0.3 mg/L to 5 mg/L.

Preferred is an electroplating composition of the present invention, wherein the one or more than one poly-organosiloxane comprises silicon in a total amount ranging from 15 wt.-% to 40 wt.-%, based on the total weight of the one or more than one polyorganosiloxane, preferably ranging from 20 wt.-% to 30 wt.-%.

The aforementioned preferred and more preferred options preferably apply to both functional and decorative applications.

Preferred is an electroplating composition of the present invention, wherein the one or more than one poly-organosiloxane comprises one or more than one vinyl moiety. More preferred is a method of the present invention, wherein the one or more than one poly-organosiloxane comprises at least one vinyl moiety comprising an unsaturated double-bond, while other vinyl moieties are involved in a cross-linking such that their double-bonds are no longer present. This preferably means that the poly-organosiloxane utilized in the method of the present invention is partially cross-linked via vinyl moieties, wherein not all vinyl moieties are used for cross-linking.

Preferred is an electroplating composition of the present invention, wherein the one or more than one poly-organosiloxane comprises, preferably consists of, carbon atoms, hydrogen atoms, silicon atoms, and oxygen atoms.

Preferred is an electroplating composition of the present invention, wherein the one or more than one poly-organosiloxane does not comprise nitrogen atoms.

Preferred is an electroplating composition of the present invention, wherein the one or more than one poly-organosiloxane does not comprise sulfur atoms.

Preferred is an electroplating composition of the present invention, wherein in the electroplating composition the one or more than one poly-organosiloxane does not comprise fluorine atoms. In other words, said one or more than one poly-organosiloxane is not fluorinated.

Preferred is an electroplating composition of the present invention, wherein the composition comprises cyclotetrasiloxanes (D4), cyclopentasiloxanes (D5), and cyclohexasiloxanes (D6) in a total concentration of 0.1 wt.-% or less, based on the total weight of the electroplating composition.

More preferably, the electroplating composition of the present invention is substantially free of cyclotetrasiloxanes (D4), cyclopentasiloxanes (D5), and cyclohexasiloxanes (D6).

Further Features of the Electroplating Composition

In the electroplating composition of the present invention no trivalent chromium ions are intentionally added. Most preferably, the electroplating composition is substantially free, preferably does not comprise, trivalent chromium ions.

Preferred is an electroplating composition of the present invention having a surface tension of 50 mN/m or less, based on a measurement with a tensiometer, preferably of 45 mN/m or less, more preferably of 40 mN/m or less, even more preferably of 38 mN/m or less, yet even more preferably of 36 mN/m or less, most preferably of 35 mN/m or less. In some cases, most preferably of 34 mN/m or less or 33 mN/m or less. In the context of the present invention it is most preferred that the tensiometer utilizes a Wilhelmy plate for determining the surface tension.

More preferred is an electroplating composition of the present invention having a surface tension ranging from 28 mN/m to 40 mN/m, based on a measurement with a tensiometer, preferably from 30 mN/m to 38 mN/m, most preferably from 31 mN/m to 36 mN/m.

This is a desired effect obtained from the combination of (ii) and (iii). Own experiments have shown that the combination does not only has a synergistic effect but furthermore allows in some cases a reduced total concentration of surface-active compounds (compare Example C3 and Example 1).

Preferred is an electroplating composition of the present invention further comprising (iv) sulfate ions.

Preferred is an electroplating composition of the present invention, wherein the source of the sulfate ions is sulfuric acid. Sulfuric acid is excellently dissolving chromium trioxide.

Preferred is an electroplating composition of the present invention, wherein the sulfate ions have a concentration ranging from 0.1 g/L to 10 g/L, based on the total volume of the electroplating composition, preferably from 1 g/L to 8.5 g/L, more preferably from 1.5 g/L to 7.5 g/L, even more preferably from 2 g/L to 6.5 g/L, most preferably from 3 g/L to 5 g/L.

In some cases an electroplating composition of the present invention is preferred, wherein the sulfate ions have a concentration ranging from 0.1 g/L to 8 g/L, based on the total volume of the electroplating composition, preferably from 0.3 g/L to 7 g/L, more preferably from 0.5 g/L to 6 g/L, even more preferably from 0.7 g/L to 5 g/L, most preferably from 1 g/L to 4 g/L. This most preferably applies to decorative applications.

Preferred is an electroplating composition of the present invention further comprising (v) one or more than one sulfonic acid and/or salts thereof with two, three or more than three sulfonic acid groups, preferably one or more than one alkylsulfonic acid and/or salts thereof with two, three or more than three sulfonic acid groups.

This most preferably applies to functional applications and is very much desired for obtaining and maintaining comparatively high current densities.

Preferred is an electroplating composition of the present invention, wherein the electroplating composition comprises one or more than one alkane di-sulfonic acid and/or salts thereof, preferably methane di-sulfonic acid and/or salts thereof. These are very preferred sulfonic acids and/or salts thereof with two sulfonic acid groups. This most preferably applies to functional applications.

Preferred is an electroplating composition of the present invention, wherein the one or more than one alkane di-sulfonic acid and salts thereof have a total concentration ranging from 0.5 g/L to 15 g/L, based on the total volume of the electroplating composition, preferably from 1 g/L to 12 g/L, more preferably from 1.5 g/L to 10 g/L. This most preferably applies to functional applications.

Preferred is an electroplating composition of the present invention, wherein the electroplating composition comprises one or more than one alkane tri-sulfonic acid and/or salts thereof, preferably methane tri-sulfonic acid and/or salts thereof. These are very preferred sulfonic acids and/or salts thereof with three sulfonic acid groups. This most preferably applies to functional applications.

Preferred is an electroplating composition of the present invention, wherein the one or more than one alkane tri-sulfonic acid and salts thereof have a total concentration ranging from 0.1 g/L to 13 g/L, based on the total volume of the electroplating composition, preferably from 0.5 g/L to 10 g/L, more preferably from 1 g/L to 7 g/L. This most preferably applies to functional applications.

Preferred is an electroplating composition according to the present invention further comprising (vi) optionally silver ions, preferably comprising silver ions.

The presence of silver ions is preferably desired for functional applications, wherein decorative applications preferably do not utilize silver ions. Silver ions preferably reduce the risk of forming too much trivalent chromium ions.

Preferred is an electroplating composition of the present invention, wherein the silver ions have a total concentration ranging from 0.0001 g/L to 3 g/L, based on the total volume of the electroplating composition, preferably from 0.001 g/L to 1 g/L, most preferably from 0.01 g/L to 0.3 g/L. This most preferably applies to functional applications.

Preferred is an electroplating composition of the present invention substantially being free of, preferably not comprising, methane sulfonic acid and salts thereof, preferably substantially being free of, preferably not comprising, alkyl-mono-sulfonic acids and salts thereof, preferably substantially being free of, preferably not comprising, mono-sulfonic acids and salts thereof. This most preferably applies to both functional and decorative applications.

Preferred is an electroplating composition of the present invention substantially being free of, preferably not comprising, alkyl sulfonic acids and salts thereof, preferably substantially being free of, preferably not comprising, sulfonic acids and salts thereof. This most preferably applies to decorative applications.

The present invention allows to fully avoid any use of fluorinated surfactants and still reaching a surface tension close or even identical to a surface tension obtained with fluorinated surfactants. This is an excellent benefit of the present invention. Preferred is an electroplating composition of the present invention, wherein the electroplating composition is substantially free of, preferably does not comprise, a fluorinated surfactant, most preferably is substantially free of, preferably does not comprise, fluorinated organic compounds. In addition, the long-term performance of the electroplating composition is not impaired (see examples below).

However, this does not exclude the use of significantly less problematic inorganic fluorine-compounds such as fluoride anions. Thus, preferred is an electroplating composition of the present invention, wherein the electroplating composition further comprises fluoride anions. This most preferably applies to decorative applications.

Preferred is an electroplating composition of the present invention, wherein the electroplating composition further comprises a fluorine-comprising inorganic compound, preferably a fluoro-silicate, most preferably $SiF_6$. This most preferably applies to decorative applications in order to increase gloss and uniformity of the chromium coating and therefore improves the optical appearance.

Preferred is an electroplating composition of the present invention, wherein the fluorine-comprising inorganic compound (preferably the fluoro-silicate, most preferably the $SiF_6$) has a total concentration ranging from 0.2 g/L to 2 g/L, based on the total volume of the electroplating composition. As mentioned, this most preferably applies to decorative applications.

Method for Electroplating

The present invention furthermore relates to a method for electroplating a chromium coating on a substrate, the method comprising the steps:

(a) providing the substrate, (b) providing an electroplating composition according to the present invention, preferably as described as being preferred, in an electroplating compartment, (c) contacting the substrate with said electroplating composition in the electroplating compartment and applying an electrical current such that the chromium coating is electroplated onto at least one surface of said substrate.

Preferably, the aforementioned features regarding the electroplating composition of the present invention apply likewise to the method of the present invention, most preferably to step (b) of the method.

Preferred is a method of the present invention, wherein in step (a) the substrate comprises a metallic substrate and/or a plastic substrate. A metallic substrate is typically preferred in functional applications as well as in decorative applications. A plastic substrate is typically preferred in decorative applications. A preferred metallic substrate comprises iron, copper, and/or zinc. A very preferred metallic substrate comprises steel and or brass, most preferably comprises a steel rod. A preferred plastic substrate comprises ABS, PA, and/or ABS-PC.

Preferred is a method of the present invention, wherein in step (c) the electroplating compartment comprises at least one anode, preferably selected from the group consisting of lead-comprising anodes, precious metal-comprising anodes, and mixed metal oxide anodes, most preferably in step (c) the electroplating compartment comprises at least one lead-comprising anode.

Preferred is a method of the present invention, wherein in step (c) the lead-comprising anodes comprise more than 50 wt.-% lead, based on the total weight of the lead-comprising anodes, preferably 60 wt.-% or more, more preferably 70 wt.-% or more, even more preferably 80 wt.-% or more, most preferably 90 wt.-% or more.

Preferred is a method of the present invention, wherein in step (c) the lead-comprising anodes are selected from the group consisting of lead-tin anodes and lead-antimony anodes.

Preferred is a method of the present invention, wherein in step (c) the precious metal-comprising anodes comprise platinized titanium anodes.

Preferred is a method of the present invention, wherein in step (c) the chromium coating has a thickness in a range from 0.05 μm to 1000 μm, preferably from 1 μm to 800 μm, more preferably from 2.1 μm to 600 μm, even more preferably from 3 μm to 400 μm, yet even more preferably from 4 μm to 300 μm, and most preferably from 5 μm to 250 μm. This most preferably applies to functional applications, most preferably starting from 2.1 μm.

Preferred is a method of the present invention, wherein in step (c) the chromium coating has a thickness in a range from 0.05 μm to 10 μm, preferably from 0.06 μm to 8 μm, more preferably from 0.07 μm to 6 μm, even more preferably from 0.08 μm to 4 μm, yet even more preferably from 0.09 μm to 3 μm, and most preferably from 0.1 μm to 2 μm. This most preferably applies to decorative applications.

Preferred is a method of the present invention, wherein in step (c) the electrical current has a cathodic current density of at least 18 $A/dm^2$, preferably of at least 25 $A/dm^2$, more preferably of at least 30 $A/dm^2$, even more preferably of at least 40 $A/dm^2$, most preferably of at least 50 $A/dm^2$. Preferably, the cathodic current density is in a range from 18 $A/dm^2$ to 260 $A/dm^2$, more preferably from 25 $A/dm^2$ to 200 $A/dm^2$, most preferably from 35 $A/dm^2$ to 100 $A/dm^2$. This most preferably applies to functional applications.

Preferred is a method of the present invention, wherein in step (c) the electrical current has a cathodic current density of at least 1 $A/dm^2$, preferably of at least 3 $A/dm^2$, more preferably of at least 5 $A/dm^2$, even more preferably of at least 7 $A/dm^2$, most preferably of at least 9 $A/dm^2$. Preferably, the cathodic current density is in a range from 1 $A/dm^2$ to 20 $A/dm^2$, more preferably from 3 $A/dm^2$ to 18 $A/dm^2$, even more preferably from, 4 $A/dm^2$ to 17 $A/dm^2$, most preferably from 5 $A/dm^2$ to 15 $A/dm^2$. This most preferably applies to decorative applications.

Preferably, in step (c) the electrical current is a direct current.

Preferred is a method of the present invention, wherein in step (c) in the electroplating compartment more than 50% of the surface of the electroplating composition is covered with a foam layer, preferably having a thickness ranging from 0.5 cm to 3 cm. This preferably applies to both functional and decorative applications. The combination of (ii) and (iii) in the present invention does not only provide a foam layer for excellent coverage against mist but furthermore provides an improved foam density.

Preferred is a method of the present invention, wherein in step (c) in the electroplating compartment more than 60% of the surface of the electroplating composition is covered with a foam layer, preferably more than 70%, even more preferably more than 80%, yet even more preferably more than 90%, most preferably more than 95%, even most preferably the entire surface of the electroplating composition is covered with a foam layer. This most preferably applies to the preferred thickness of the foam layer ranging from 0.5 cm to 3 cm. This preferably applies to both functional and decorative applications.

Preferred is a method of the present invention, wherein in step (c) the electroplating composition has a temperature in a range from 20° C. to 90° C., preferably from 30° C. to 70° C., more preferably from 40° C. to 60° C., most preferably from 45° C. to 58° C. This most preferably applies to functional applications.

In other cases a method of the present invention is preferred, wherein in step (c) the electroplating composition has a temperature in a range from 20° C. to 70° C., preferably from 25° C. to 60° C., more preferably from 30° C. to 60° C., most preferably from 35° C. to 50° C. This most preferably applies to decorative applications.

Preferred is a method of the present invention, wherein step (c) is performed for a time period from 1 minute to 200 minutes, preferably from 2 minutes to 100 minutes, more preferably from 3 minutes to 60 minutes. This preferably applies to both functional and decorative applications.

However, in some cases a method of the present invention is preferred, wherein step (c) is performed for a time period from 1 minute to 15 minutes, preferably from 1.5 minutes to 12 minutes, more preferably from 2 minutes to 10 minutes. This preferably applies to decorative applications.

In other cases, a method of the present invention is preferred, wherein step (c) is performed for a time period from 5 minutes to 180 minutes, preferably from 10 minutes to 100 minutes, more preferably from 11 minutes to 60 minutes. This preferably applies to functional applications.

By performing the method step (c) in the abovementioned preferred temperature ranges and/or (preferably and) for the preferred time periods particularly advantageous electrodeposition kinetics during step (c) can be ensured.

In some cases, preferred is a method of the present invention further comprising after step (c) step (d) heat-treating the chromium-coated substrate obtained from step (c).

This preferably applies to functional applications.

Preferred is a method of the present invention, wherein in step (d) the heat-treating is carried out at a temperature in a range from 100° C. to 250° C., preferably from 120° C. to 240° C., more preferably from 150° C. to 220° C., most preferably from 170° C. to 200° C.

Preferred is a method of the present invention, wherein in step (d) the heat-treating is carried out for a time period from 1 hour to 10 hours, preferably from 2 hours to 4 hours.

By preferably performing a heat-treatment in step (d), more preferably at the preferred temperatures and/or for the preferred time periods, the properties of the chromium coating can be further improved (e.g. reduction of hydrogen embrittlement).

Preferred is a method of the present invention, wherein in step (c) the cathodic current efficiency (CCE) is in range from 20% to 30%, more preferably from 22% to 27%. This most preferably applies to functional applications.

The present invention further relates to a use of a polyorganosiloxane in an electroplating composition for reducing the surface tension, preferably in an electroplating composition for plating a chromium coating from hexavalent chromium, most preferably in combination with one or more than one betaine comprising a quaternary nitrogen and/or salts thereof.

The aforementioned regarding the electroplating composition of the present invention as well as the method of the present invention preferably applies likewise to the use of the present invention.

The present invention is described in more detail by the following non-limiting examples.

EXAMPLES

For all examples below, the following base electroplating composition was used:

(i) Chromic acid, 250 g/L;

(ii) N-Octadecyl-N,N-dimethyl-3-ammonio-1-propanesulfonate, in various concentrations;

(iii) emulsified and homogenously distributed 3D-polyorganosiloxane (i.e. a 3D siloxane from Münzing Chemie GmbH); in various concentrations;

(iv) Sulfate ions, 2 to 5 g/L (added as sulfuric acid);

(v) Methane-di-sulfonic acid, 1.5 to 10 g/L;

pH strongly acidic

First Set of Experiments (Surface Tension)

In a first set of experiments, various concentrations of (ii) and (iii) were tested as summarized in Table 1 below. For every experiment, the surface tension was determined, wherein only for favorable combinations a test plating was carried out. Favorable means that a desired thickness of up to 3 cm coverage with the foam layer was obtained with additionally having a desired foam structure and moderate bubble size (improved foam density).

The surface tension (ST) was measured with a tensiometer with Wilhelmy plate made of Pt-Ir (DCAT 9, Dataphysics).

TABLE 1

Results of the first set of experiments, surface tension (beaker experiments)

| No. | (ii) [mg/L] | (iii) [mg/L] | ST [mN/m] |
|---|---|---|---|
| C1 | 0 | 0 | 73 |
| C2 | 10 | 0 | 39 |
| C3 | 20 | 0 | 37 |
| C4 | 30 | 0 | 37 |
| C5 | 0 | 0.8 | 56 |
| C6 | 0 | 1.6 | 52 |
| C7 | 0 | 2.4 | 53 |
| 1 | 10 | 0.8 | 36 |
| 2 | 20 | 1.6 | 35 |
| 3 | 30 | 2.4 | 34 |
| 4 | 40 | 3.2 | 33 |
| 5 | 50 | 4 | 32 |
| 6 | 60 | 4.8 | 32 |
| 7 | 70 | 5.6 | 31 |
| 8 | 80 | 6.4 | 31 |
| 9 | 90 | 7.2 | 30 |
| 10 | 100 | 8 | 30 |
| 11 | 30 | 0.8 | 35 |
| 12 | 30 | 1.6 | 35 |
| 13 | 40 | 2.4 | 34 |
| 14 | 50 | 2.4 | 34 |
| 15 | 60 | 2.4 | 34 |
| 16 | 30 | 3.2 | 33 |
| 17 | 30 | 4 | 33 |
| 18 | 30 | 4.8 | 32 |
| 19 | 30 | 5.6 | 31 |
| 20 | 30 | 6.4 | 31 |
| 21 | 30 | 7.2 | 31 |
| 22 | 30 | 8 | 30 |
| 23 | 30 | 8.8 | 30 |

C1 to C7 denote comparative examples because only either (ii) or (iii) is present in the electroplating composition. For the sake of comparison, with commonly used fluorinated surfactants a surface tension typically ranging from 28 to 32 mN/m is obtained (data not shown).

Furthermore, C2 to C4 in each case showed a too strong foam formation, wherein C5 to C7 showed no foaming at all, which is not acceptable because of missing any mist suppression.

In contrast, experiments 1 to 23 are examples according to the invention comprising both (ii) and (iii).

As shown in Table 1, all comparative examples prove that each individual compound, i.e. (ii) alone and (iii) alone, cannot reach the surface tension obtained with a combination of (ii) and (iii). Interestingly, (iii) alone results only in a moderate decrease of the surface tension (see C6, 52 mN/m), wherein (ii) alone results already in a significant decrease of surface tension (see C3 and C4, 37 mN/m). This shows that (ii) alone has a significant potential to decrease the surface tension in the electroplating composition.

However, as also clearly shown in Table 1, the combination of (ii) and (iii) further decreases the surface tension (see No. 1 to 10). This is very surprising, because the obtained surface tension is lower than expected by (ii) and (iii) alone. Thus, (iii) clearly enhances the decreased surface tension further. In this sense, (iii) synergistically supports the effect of (ii) in an unexpected way.

This synergistic effect can be even more clearly seen in experiments 16 to 23, wherein (ii) remains constant at 30 mg/L and (iii) varies from 3.2 to 8.8 mg/L. With increasing concentration of (iii) an even further decreased surface tension is obtained. Although similar surface tensions were obtained in No. 9 and 10, No. 21 to 23 show that the presence of (iii) essentially contributes to the excellent surface tension of about 30 and 31 mN/m, respectively.

In all experiments no fluorinated organic compounds were utilized. However, similarly good or even identical surface tensions were obtained with fluorine-free organic compounds compared to commonly used fluorinated organic compounds.

In further comparative examples emulsified polydimethylsiloxane was used instead of the 3D-siloxane in two concentrations (0 mg/L as control, 2.4 mg/L, and 4.8 mg/L). In these examples 30 mg/L of (ii) was present. However, for each case an overall surface tension of 38 mN/m was obtained. Furthermore, polydimethylsiloxane alone did not contribute to a surface tension reduction. Thus, the presence of polydimethylsiloxane does not lead to a synergistic effect in combination with a betaine.

This effect was confirmed and is applicable to functional as well as decorative applications (electroplating results for decorative applications are not particularly shown).

Second Set of Experiments (Long-Term Performance)

In a second set of experiments, the long-term performance of the electroplating composition of the present invention was investigated. It is commonly accepted that the cathodic current efficiency (CCE) determined over time is a key indicator whether the performance of the composition can be considered stable or not. Typically, if decomposition products accumulate over time, the CCE is significantly dropping, which is highly undesired. Since, chromic acid-based electroplating compositions represent a highly acidic and oxidative chemical environment, formation of break-down products from non-fluorinated compounds is inevitable. The cathodic current efficiency in % was calculated according to Faraday law and gravimetric analysis.

Thus, CCE was determined for three different volumes (900 ml=A, 2 L=B, and 110 L=C). Thus, also three different plating compartment geometries were used. While 900 ml and 2 L were tested in a beaker, 110 L were tested in a suitable plating tank. It is noteworthy that in each case a different ratio between electroplating composition surface to electroplating composition volume was obtained. Our own experiments have shown that depending on such a ratio, different combinations of (ii) and (iii) are considered to be favourable in view of foam layer thickness and foam layer coverage.

The following favourable combinations of (ii) and (iii) were tested as summarized in Table 2.

TABLE 2

Starting concentrations tested for CCE experiments

| No. | (ii) [mg/L] | (iii) [mg/L] |
|---|---|---|
| A | 30 | 5.6 |
| B | 30 | 1.6 |
| C | 30 | 1.6 |

CCE was determined by test electroplating with the following parameters:

Temperature: 55° C.;

Cathodic current density: 50 A/dm$^2$;

Anode: PbSn

Test electroplating was carried out up to 1044 Ah/L (in Table 3 also named "Age" representing Ah/L). During test electroplating compounds (ii) and (iii) were replenished based on visual inspection of the foam layer, which must fully cover the surface but without accumulation of foam close in corners and tank walls.

As substrate mild steel rods with 10 mm diameter were used. Prior to electroplating, the substrates were pre-treated by degreasing with acetone.

No disturbing optical defects were found upon visual inspection of the chromium coating after test electroplating.

The cathodic current efficiency in % (CCE) was calculated according to Faraday law and gravimetric analysis.

The following results were obtained as summarized in Table 3.

TABLE 3

Results of the second set of experiments, stability (CCE)

| A | | B | | C | |
|---|---|---|---|---|---|
| Age | CCE | Age | CCE | Age | CCE |
| 6 | 24.0 | 46 | 24.8 | 45 | 25.3 |
| 64 | 24.3 | 393 | 24.9 | 111 | 25.5 |
| 162 | 24.4 | 713 | 24.9 | 120 | 25.5 |
| 212 | 23.3 | 1044 | 25.8 | 182 | 25.5 |
| 263 | 25.3 | | | 249 | 26.2 |
| 366 | 25.1 | | | 312 | 25.1 |
| 449 | 24.5 | | | | |
| Average | 24.4 | | 25.1 | | 25.5 |

Typically, the CCE for conventional electroplating compositions comprising fluorinated organic compounds is about 25% over time.

Table 3 clearly shows that in A, B, and C the CCE is comparatively constant; no significant drop was observed. These results confirm a stable long-term performance of the electroplating compositions. Although it is assumed that break-down products are formed, they did not accumulate over the test period and it can be concluded that there is no significant accumulation of detrimental break-down products over even longer time periods. It is rather assumed that even break-down products are significantly decomposed and therefore not accumulating.

Furthermore, Table 3 shows that the CCE is not only constant but also in absolute terms still ranging about 25%. This is an excellent result because even with fluorinated organic compounds in conventional electroplating compositions 25% are obtained. Thus, the combination of (ii) and (iii) does not negatively affect the current efficiency even in long time applications.

The second set of experiments was carried out specifically for functional electroplating.

The invention claimed is:

1. An electroplating composition for plating a chromium coating on a substrate, the composition comprising:

(i) a source of hexavalent chromium;

(ii) one or more than one betaine comprising a quaternary nitrogen and/or salts thereof; and (iii) one or more than one poly-organosiloxane, wherein the one or more than one poly-organosiloxane comprises a 3D-poly-organoliloxane.

2. The electroplating composition according to claim 1, wherein said one or more than one betaine comprises a compound of formula (I)

$$(R^1)N^+(R^2R^3)\text{-}X\text{-}Y \quad (I),$$

wherein independently $R^1$ denotes alkyl, alkyl ester, or alkyl amide, $R^2$ and $R^3$ denote a C1-C5 linear or branched alkyl;

X denotes a divalent moiety; and

Y denotes a sulfonic acid group or a carboxylic acid group.

3. The electroplating composition according to claim 2, wherein independently $R^1$ denotes a C16-C18 linear alkyl;

$R^2$ and $R^3$ denote methyl or ethyl;

X denotes a C2-C4 alkylene moiety; and

Y denotes a sulfonic acid group.

4. The electroplating composition according to claim 1, wherein the poly-organosiloxane is crosslinked.

5. The electroplating composition according to claim 1, wherein the one or more than one poly-organosiloxane is amphiphilic.

6. The electroplating composition according to claim 1, wherein the one or more than one poly-organosiloxane is surface-active.

7. The electroplating composition according to claim 1, wherein said one or more than one polyorganosiloxane is emulsified in the electroplating composition.

8. The electroplating composition according to claim 1, wherein in the electroplating composition said one or more than one poly-organosiloxane is homogeneously distributed.

9. The electroplating composition according to claim 1, wherein the electroplating composition is substantially free of polydimethylsiloxane, and is substantially free of a silicone oil.

10. The electroplating composition according to claim 1 having a surface tension of 50 mN/m or less, based on a measurement with a tensiometer.

11. The electroplating composition according to claim 1 substantially being free of methane sulfonic acid and salts thereof, substantially being free of alkyl-mono-sulfonic acids and salts thereof, substantially being free of mono-sulfonic acids and salts thereof.

12. A method for electroplating a chromium coating on a substrate, the method comprising the steps:

(a) providing the substrate, (b) providing the electroplating composition according to claim 1 in an electroplating compartment, (c) contacting the substrate with said electroplating composition in the electroplating compartment and applying an electrical current such that the chromium coating is electroplated onto at least one surface of said substrate.

13. The method of claim 12, wherein in step (c) the electroplating compartment comprises at least one anode.

14. The method of claim 12, wherein in step (c) in the electroplating compartment more than 50% of the surface of the electroplating composition is covered with a foam layer.

* * * * *